United States Patent [19]

Perrin et al.

[11] 4,260,117

[45] Apr. 7, 1981

[54] DUAL ROLL TOWEL DISPENSER

[75] Inventors: Jack L. Perrin, Los Angeles; Council A. Tucker, Glendale, both of Calif.

[73] Assignee: Towlsaver, Inc., City of Industry, Calif.

[21] Appl. No.: 94,469

[22] Filed: Nov. 15, 1979

[51] Int. Cl.[3] ..... B65H 19/04

[52] U.S. Cl. ..... 242/55.3; 242/55.53

[58] Field of Search ..... 242/55.3, 55.2, 55.53; 312/39, 40, 41; 226/130, 132

[56] References Cited

U.S. PATENT DOCUMENTS

| | | | |
|---|---|---|---|
| 1,825,706 | 10/1931 | Sherman | 282/21 D |
| 3,184,176 | 5/1965 | Tucker | 242/55.3 |
| 3,214,014 | 10/1965 | Perrin | 206/58 |
| 3,294,329 | 12/1966 | Tucker | 242/55.3 |
| 3,381,909 | 5/1968 | Tucker | 242/55.3 |
| 3,606,125 | 9/1971 | Tucker | 226/130 |
| 4,003,526 | 1/1977 | Fishburn | 242/55.3 |
| 4,025,004 | 5/1977 | Massey | 242/55.3 |

*Primary Examiner*—Edward J. McCarthy
*Attorney, Agent, or Firm*—Thomas R. Lampe

[57] ABSTRACT

A pitoval, generally vertically reciprocal operating handle carries a rack along a stationary center, rotatable pinion with the pinion, in turn, being operably connected rotating a continuous drive rod. Two drive rolls are mounted axially aligned on the drive rod and rotatable relative thereto with a clutch spool on the rod between the drive rolls being axially shiftable to transmit rotation from the rod to either of the drive rolls while the other roll remains stationary. Each of the drive rolls with the assistance of a pressure roll grips a paper web extending from a supply roll so that rotation of the particular drive roll dispenses that web from the dispenser. Pivotal sensors are mounted sensing the periphery of each supply roll so that upon substantial depletion of a particular supply roll, that sensor engages a shuttle causing the shuttle to shift the clutch from that associated drive roll to the other, thereby commencing the dispensing by the other drive roll from its supply roll. Thus, diepensing is automatically shifted from one supply roll to the other in either direction as long as the supply rolls are kept replenished ahead of such switching. The dispenser may also include anti-milking devices in the main drive and individually for each of the drive rolls, as well as separable core supply rolls to provide for full paper web use and accurate clutch switching between the drive rolls.

47 Claims, 15 Drawing Figures

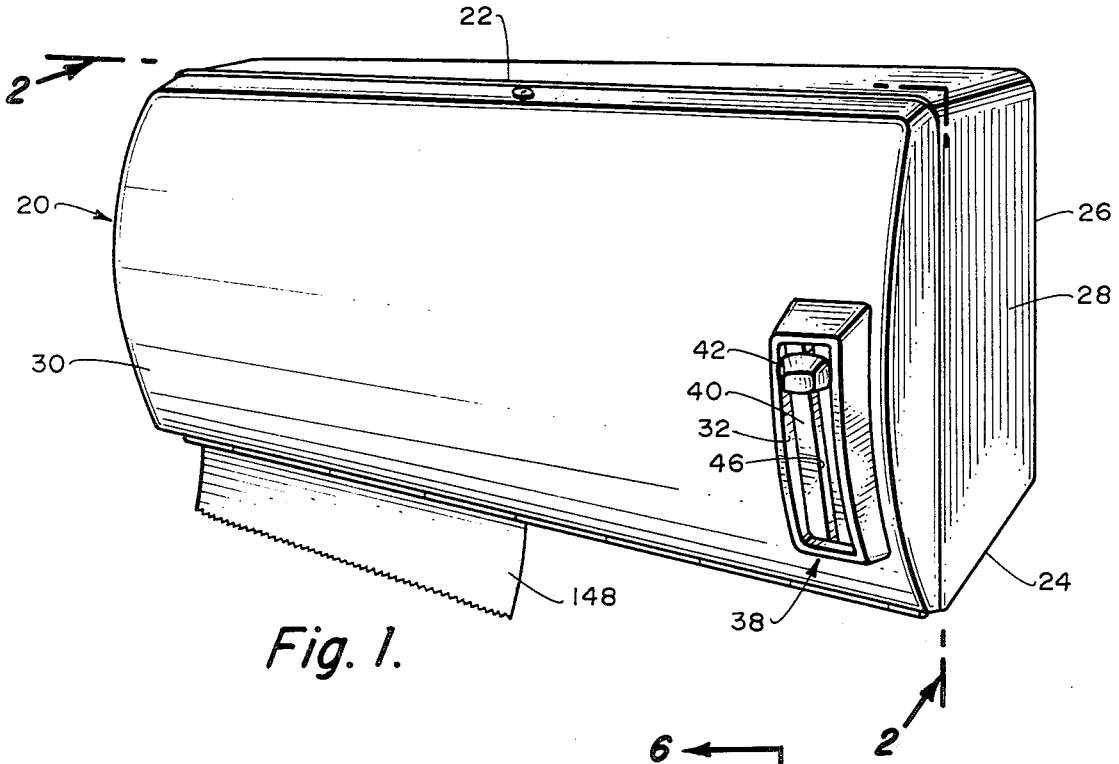
Fig. 1.
Fig. 5.
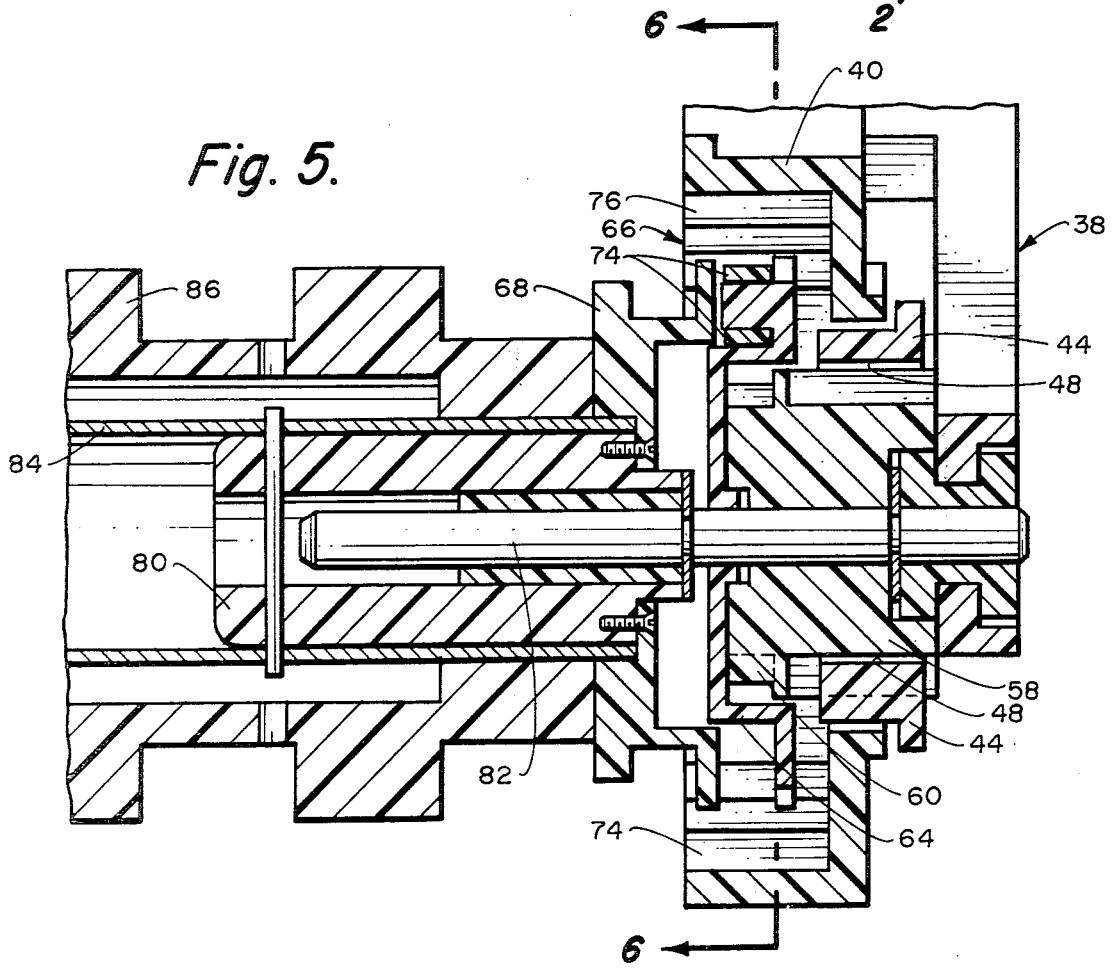

22
148
20
28
94
30
54
150
52
42
4
4
40
44
56
50
38
5
48
76
58
32
36
34
24
5

DUAL ROLL TOWEL DISPENSER

BACKGROUND OF THE INVENTION

This invention relates generally to a dispenser of the type for dispensing continuous webs of material such as continuous webs of paper towels and the like. More particularly, this invention is directed to such a dispenser adapted for dispensing a continuous first web of material from a first web supply until that first web supply is substantially depleted and during which a continuous second web of material from a second web supply remains free of any dispensing, and then, automatically shifting to dispensing the second web from the second web supply. Furthermore, in one preferred form, the dispenser may be further adapted to continue the dispensing of the second web until the second web supply is substantially depleted and then, assuming an intervening replenishment of the first web supply during the second web dispensing, automatically shifting back to dispensing the now replenished first web from the now replenished first web supply, the dispenser in this preferred form being capable of such alternate shifting on a continuing basis as long as the intervening web supply replenishments are carried out. Still further, in a preferred embodiment form, the princples of the present invention are applied to the structure of a dual roll towel dispenser and whether in that form or another application of the principles of the present invention may include various other component features which contribute to provide a unique dual dispenser construction of maximum efficiency while still maintaining maximum operational qualities.

Various forms of continuous web dispensers have heretofore been provided, the most common example thereof being roll towel dispensers. For instance, the usual roll towel dispenser includes a rotatable supply roll of continuously wound paper webs with the paper web extending therefrom between a drive roll and an abutting pressure roll, and finally from the dispenser through a slot containing a tear blade. Although the dispenser can be power actuated, it is usually manually actuated by the movement of an operating handle in a determined manner for causing the paper web to be dispensed from the dispenser.

Obviously, if a roll towel dispenser is to be serviceable for its intended purpose, it must be maintained with a paper towel supply and this means the periodical replenishment of the towel supply roll. Thus, maintenance personnel are charged with the duty of periodically opening the various roll towel dispensers and surveying the condition of the towel roll therein, and if such towel roll is sufficiently depleted, replacing the same with a new roll. With the prior roll towel dispensers, this required maintenance operation has presented two distinct problems of an increasingly troublesome nature, one involving labor costs and one involving material costs and waste.

Labor costs in our modern economy are continuously rising at least partially due to the continuous upward spiral of inflation which has resulted in the constant search for labor cost reductions. In this particular instance, assuming that the same prior roll towel dispensers are used, maintenance labor costs can only be reduced in one manner and that is less frequent maintenance supply checks of the dispensers. The inevitable result is that at least certain of the dispensers will not be sufficiently periodically checked in order to maintain towel supplies therein at all times and this, in turn, results in inconvenience to the required users of the dispensers.

As to the material cost and waste problem, it is well known that the cost of paper has been rising at a progressively rapid rate and if the roll towel dispensers of the type herein involved are properly serviced by the maintenance personnel, waste problems necessarily result. If the dispensers are properly serviced prior to the towel supply rolls therein being depleted in order that the dispensers will always have a supply of paper towels for dispensing the same therefrom, the towel supply rolls are necessarily removed and replaced prior to the old roll being completely depleted. If the old towel supply rolls remain in the dispensers until they are completely depleted, then the dispensers will necessarily be in a completely depleted and non-usable condition for a period of time prior to the next maintenance operation so as to inconvenience the required users of the dispensers. Thus, on the one hand waste is created by not completely using the towel supply rolls even though, in this case, the dispensers are always maintained serviceable, and on the other hand, although the waste problem can be eliminated by always completely using the towel supply rolls in the dispensers, the dispensers are only periodically serviceable for use by the intended users.

OBJECTS AND SUMMARY OF THE INVENTION

It is, therefore, an object of this invention to provide a dual continuous web dispenser of the type having two separate continuous web supplies presenting two separate continuous webs for dispensing, initially, one web being dispensed during operation of the dispenser by a user until that web supply is substantially depleted and while the other web remains free of dispensing, at which time, the dispenser automatically shifts to the other web for dispensing from the other web supply. As a result, not only is the first dispensed web dispensed until its web supply has been completedly depleted so as to eliminate any possible waste, but the maintenance operations for replenishing the web supplies can be conveniently scheduled to coincide with the switchover and dispensing of the second web at any time intermediate the dispensing of such second web. If the dispenser of the present invention is in this simplified form, that is, only capable of shifting in a single predetermined direction from a predetermined first web to a predetermined second web, in order to avoid waste while still maintaining the dispenser capable of dispensing at all times, the maintenance operation carried out intermediate the dispensing of the second web from its web supply would necessarily require the removal of the now partially used second web supply from its original second web supply position and the installation of the same into the first web supply position with the new web supply being installed in the second web supply position. In this manner with this maintenance procedure, all web supplies would be completely depleted on a continuing basis and no waste would occur.

However, by provision of the dispenser of the present invention in a slightly more sophisticated form, the dispenser can be adapted to automatically shift between the web supplies in both directions, that is, from the first to the second, back to the first and back to the second, and so forth. With this form of dispenser, after one of the web supplies is completely depleted and the dispenser has automatically shifted to dispensing the other web from the other web supply, the maintenance operation merely need be scheduled during that dispensing of the other web from the other web supply and the maintenance operation merely consists of replacement of the totally depleted web supply through certain simple procedure without disturbing that web supply presently being dispensed. This, of course, greatly simplifies the maintenance operation while still assuring complete use always of the web supplies until totally depleted so as to eliminate the possibility of waste. Furthermore, in either the simplified or more sophisticated dispenser form, with the dual web supplies and the alternate dispensing of the same, much less frequent maintenance operations are required so as to greatly reduce maintenance labor costs.

It is a further object of this invention to provide a dual continuous web dispenser of the foregoing general form having means incorporated in the web supplies cooperating with web supply sensing means of the dispenser which insures that proper web supply sensing takes place and that a given web supply is first completely depleted prior to the dispenser automatically shifting to the other web supply for the dispensing thereof. In a preferred embodiment of the present invention, the web supplies are in the form of web supply rolls having the webs continuously wound thereon and by forming these web supply rolls with separable cores, the depletion sensing of the web supply rolls can be more positively regulated. In a web supply roll having a separable core, the continuously wound web of the roll maintains the separable core in assembly and when the web of the supply roll is substantially completely depleted, the separable core can be generally radially separated, thereby very positively physically signalling depletion of the web supply. By use of web supply rolls having this separable core construction, the web of the supply roll can be continuously peripherally sensed by radially movable sensing means and when the web is substantially depleted, the sensing means will automatically move through the supply roll core positively separating the same. This permits the sensing means to move through the core into a position directly engaging transfer means causing the shifting of the dispenser into its new supply roll dispensing, all on this improved positive basis.

It is still a further object of this invention to provide a dual continuous web dispenser which may have any or all of the foregoing advantageous features and which may further include one or more various anti-milking means incorporated therein to prevent improper dispenser use which could result in extreme web material waste if not completely frustrated. It is well known that with dispensers of the general character herein involved, some users of the dispensers will make attempts at removing the web material being dispensed therefrom on a continuous basis without proper operation of the dispenser by grasping and pulling the web from the dispenser, thus the term "milking." According to a preferred form of the present invention, a primary anti-milking means may be provided in the main drive between the dispenser operating means and the dispensing means thereof to which the operating means is then shifted and this anti-milking means prevents any removal of the then being dispensed web other than by proper operation of the dispenser, that is, either by attempting to remove the web being dispensed during its dispensing at a faster rate than such dispensing or by attempting to remove that web when the dispenser is not being operated. The dispenser of the present invention may also include separate secondary anti-milking means for each of the dual webs, in each case, the secondary anti-milking means preventing that web from being pulled from the dispenser when the dispenser is not shifted to dispensing that web and is dispensing the other web.

Other objects and advantages of the invention will be apparent from the following specification and the accompanying drawings which are for the purpose of illustration only.

BRIEF DESCRIPTION OF THE DRAWINGS

FIG. 1 is a front perspective view of the dispenser incorporating a preferred embodiment of the dual continuous web dispenser principles of the present invention;

FIG. 5 is an enlarged, fragmentary, generally vertical sectional view looking in the direction of the arrows 5—5 in FIG. 3;

DESCRIPTION OF THE BEST EMBODIMENTS COMTEMPLATED

Figure 2:
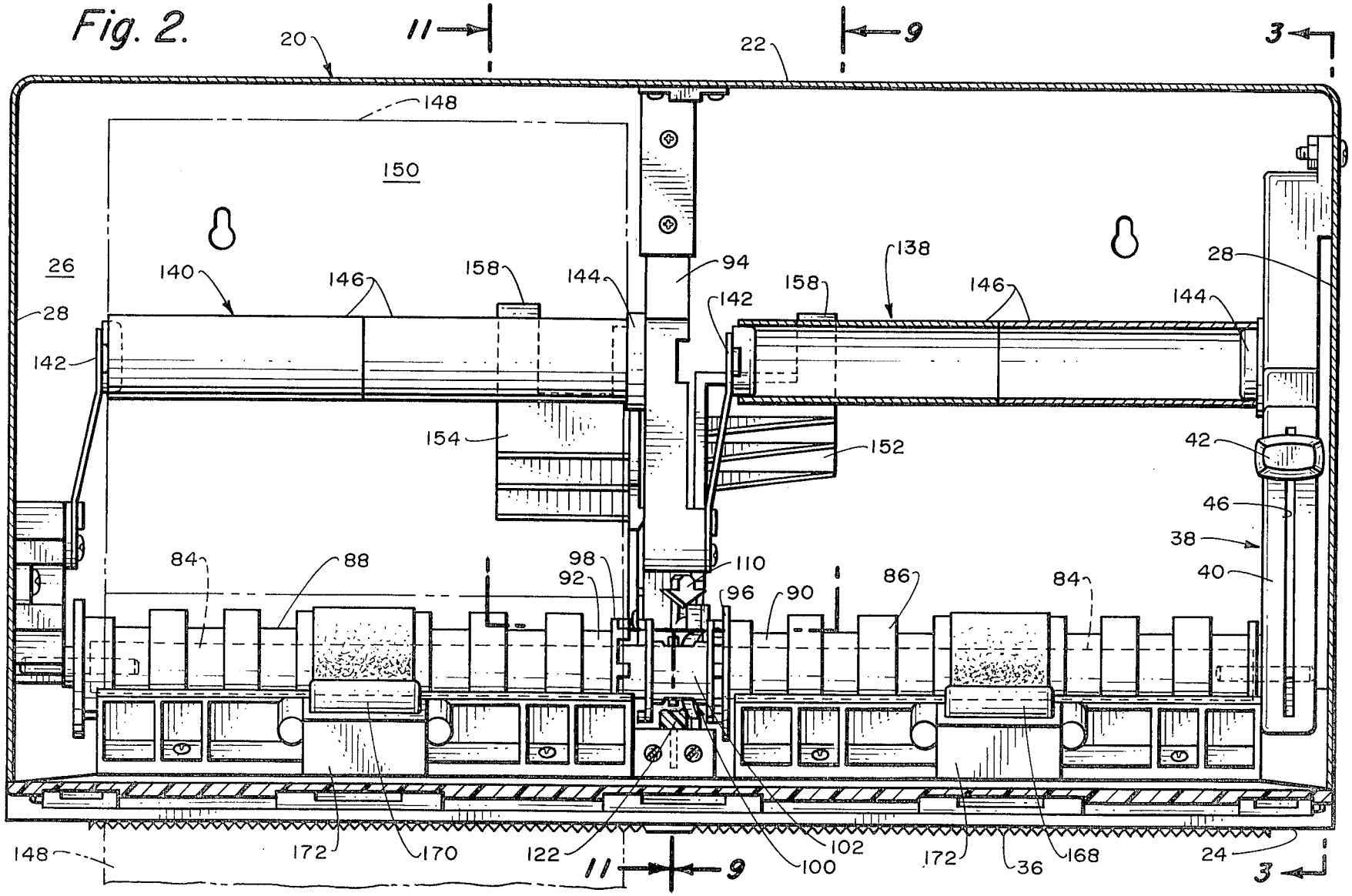
FIG. 2 is an enlarged, vertical sectional view, part in front elevation, looking in the direction of the arrows 2—2 of FIG. 1.
Figure 3:
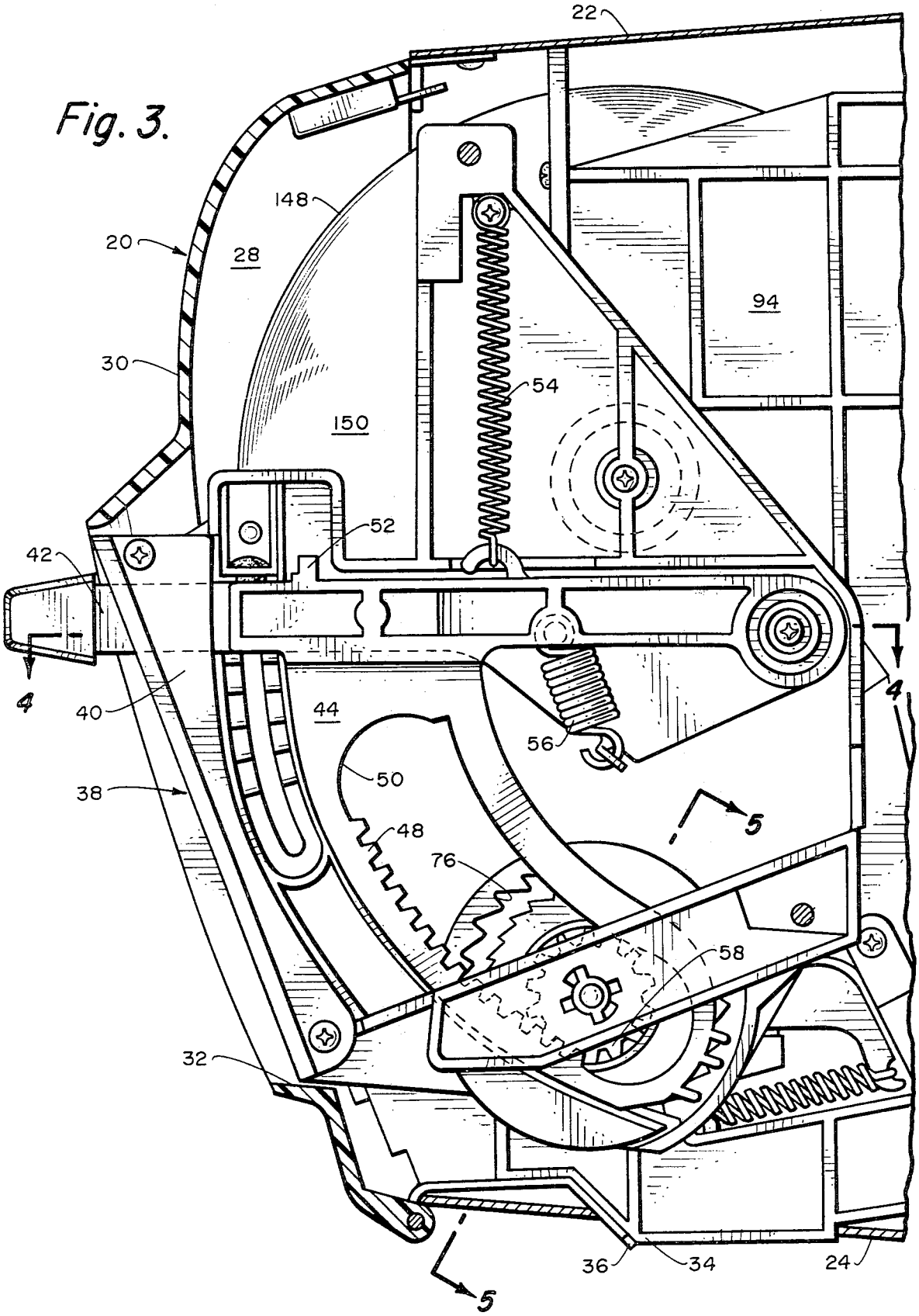
FIG. 3 is an enlarged, fragmentary, vertical sectional view, part in side elevation, looking in the direction of the arrows 3—3 in FIG. 2.
Figure 4:
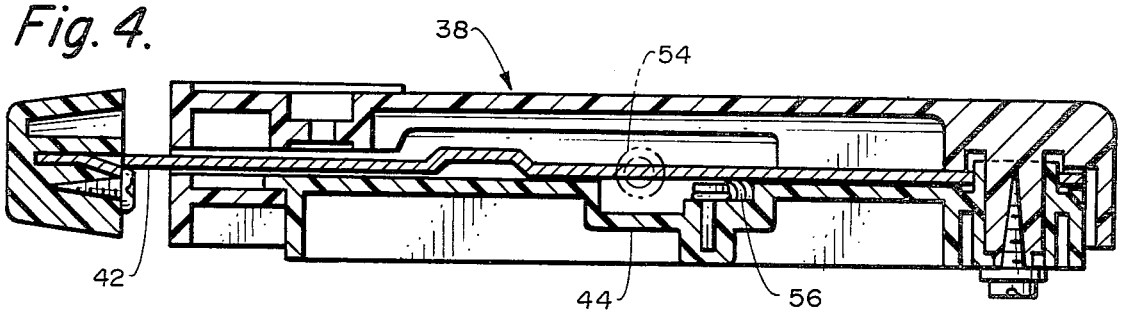
FIG. 4 is a horizontal sectional view looking in the direction of the arrows 4—4 in FIG. 3.

Referring for the moment to FIGS. 1 through 3, the preferred embodiment of the dual continuous web dispenser of the present invention, specifically in the form of a dual roll towel dispenser, is shown and includes a rigid hollow case generally indicated at 20 of generally rectangular shape formed by top wall 22, bottom wall 24, back wall 26 and opposite end walls 28 secured together with a downwardly pivotal front wall 30. The front wall 30 is formed adjacent the right edge thereof with a generally vertically extending, flanged lever opening 32 for a purpose to be hereinafter described. Also, the bottom wall 24 spaced rearwardly from the forward edge thereof is formed with the usual dispenser slot or slots 34 bordered by a usual tear-off serrated edge 36 of the type conventionally found in dispensers of the character involved.

As can be best seen in FIGS. 1 through 8, an operating device generally indicated at 38 is mounted on the case right hand end wall 28 and is formed by a stationary frame 40 vertically pivotally mounting a forwarding projecting operating lever 42 and separately vertically pivotally mounting a rack carriage 44 pivotal about the same horizontal pivot axis adjacent to the lever. The operating lever 42 projects forwardly of the frame 40 through a lever guide slot 46 so that with the case front wall 30 is closed position as shown, for instance, in FIGS. 1 and 3, the forward part of the operating device frame 40 projects into the lever opening 32 of the case front wall 30 and the lever 42 projects forwardly thereof accessible outwardly of the case front wall. An arcuate, generally vertically extending rack 48 is formed along a lower edge of an arcuate rack opening 50 of the rack carriage 44 and a generally horizontal flange 52 at the upper edge of the rack carriage 44 overlies the operating lever 42. The operating lever 42 is resiliently urged pivotally upwardly to its upper, generally horizontal position shown in FIG. 3 by a tension spring 54 upwardly attached to the operating device frame 40 and downwardly to the operating lever, while the rack carriage 44 is resiliently urged downwardly relative to the operating lever 42 by a tension spring 56 upwardly connected to the rack carriage and downardly connected to the operating lever.

Thus, downward pivotal movement of the operating lever 42 is resisted by the spring 54 and this spring returns the operating lever to its upper position of FIG. 3 upon release thereof. Furthermore, upon downard pivotal movement of the operating lever 42, the rack carriage 44 is resiliently urged to follow by the spring 56, although some relative movement therebetween can take place as controlled by that spring. The rack carriage 44 is forced to follow the operating lever 42 in upward movement due to the flange 52 forcing the rack carriage to follow the operating lever.

Figure 8:
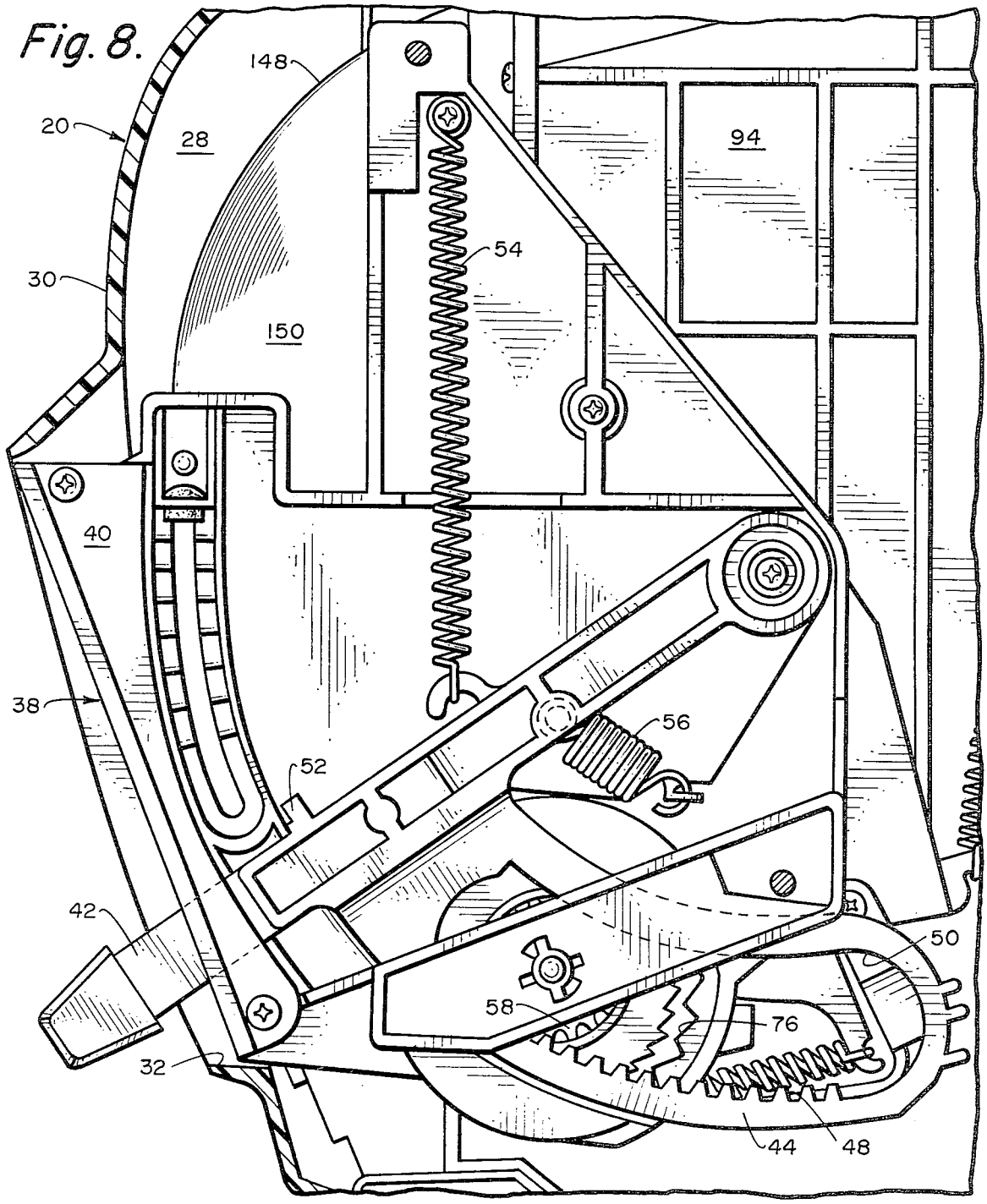
FIG. 8 is a view similar to FIG. 3, but with the operating lever in a downward pivoted position at the lower end of its generally vertical pivotal stroke.

As best seen in FIGS. 3 and 5 through 8, a fixed center pinion 58 is rotatably mounted on the operating device frame 40 generally axially aligned with the rack carriage 44 within the rack opening 50 and operably engaged with the rack 48. The relative positioning of the rack carriage 44 and pinion 58 is such that when the operating lever 42 and rack carriage 44 are in their upper pivoted positions ready for a downward pivotal stroke, the pinion 58 is at the lower end of the rack 48 and the rack moves progressively along the pinion rotating it in a counterclockwise direction as viewed in FIG. 3 as the rack carriage moves pivotally downwardly as shown in FIG. 8. Axially inward of the rack carriage 44, the pinion 58 has a ratchet drive wheel 60 secured rotatable therewith and the ratchet drive wheel is peripherally engaged by ratchets 62 of a telescoping ratchet driven wheel 64.

Thus, to this point in the operational drive of the dispenser, downward pivotal movement of the operating lever 42 carrying the rack carriage 44 from the position of FIG. 3 to the position of FIG. 8 moves the rack 48 along the pinion 58 rotating the pinion in the counterclockwise direction as viewed in FIGS. 3 and 8. This, in turn, rotates the ratchet drive wheel 60 in the counterclockwise direction as viewed in FIG. 6 with the ratchets 62 carrying the ratchet driven wheel 64 therewith in this counterclockwise direction. Release of the operating lever 42 at any time during its downward stroke which would usually normally be near the lower end of such stroke (FIG. 8) permits the operating lever and rack carriage 44 to pivot reversely upwardly from the position shown in FIG. 8 to the position shown in FIG. 3, but since the pinion 58 and the ratchet drive wheel are now rotating in the opposite clockwise direction, the ratchet drive wheel 64 will remain stationary due to the ratchets 62 moving reversely over the ratchet drive wheel 60 in usual single direction ratchet functioning.

The ratchet driven wheel 64 is operably connected into and for operationally driving the web dispensing portion of the dispenser by a primary anti-milking device generally indicated at 66 and best seen in FIGS. 5 through 7, it being shown in FIGS. 6 and 7 in its engaged or locked position preventing the unauthorized "milking" as will be hereinafter more clearly described. The purpose of this primary anti-milking device 66 is to prevent the "milking" of the dispenser by attempting to grasp the web being dispensed from the dispenser and pulling it from the dispenser in an unauthorized manner. Relative to this primary anti-milking device 66, it is involved in the main operational drive of the dispenser so that its purpose is to not only prevent milking of the dispenser when the operating device 38 is stationary and not being operated, as well as to prevent milking of the web being dispensed ahead of or at a faster rate than it is being dispensed when operational dispensing is actually taking place. It is pointed out that this primary anti-milking device 66 is quite similar and operates in a quite similar manner to the anti-milking device shown and described in our prior U.S. Pat. No. 3,606,125 issued Sept. 20, 1971.

The primary anti-milking device 66 includes a roll drive collar 68 coaxially inwardly adjacent the ratchet drive wheel 64 rotatable on the operating device frame 40 separate from the ratchet driven wheel as shown. An angled cam 70 and a circumferentially spaced radial cam 72 are secured to the roll drive collar 68 projecting axially therefrom radially overlying the ratchet driven wheel 64 circumferentially between the ratchets 62, and an engagement dog 74 is radially pivotally mounted on the ratchet driven wheel 64 extending circumferentially between the angled and radial cams 70 and 72. A toothed stop ring 76 secured on the operating device stationary frame 40 telescopes all of the spring ratchet 62 and the engagement dog 74 of the ratchet driven wheel 64 and the angled and radial cams 70 and 72 of the roll drive collar 68. Finally, a coiled control spring 78 projects axially between the ratchet driven wheel 64 and the roll drive collar 68 end secured in each, as best seen in FIG. 7.

Figure 6:
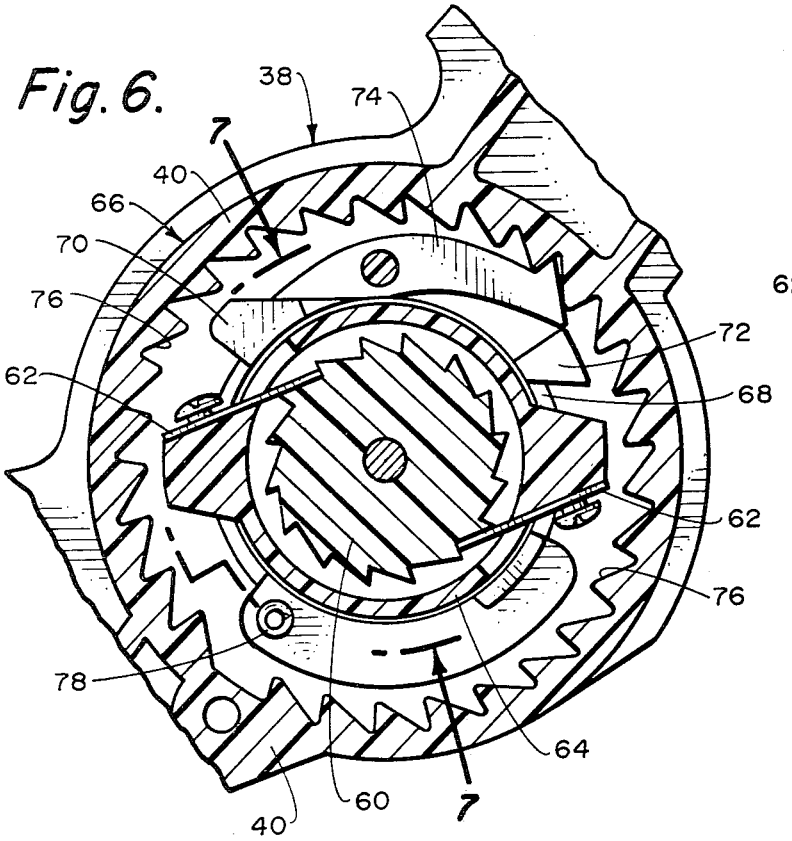
FIG. 6 is a fragmentary, vertical sectional view looking in the direction of the arrows 6—6 in FIG. 5.
Figure 7:
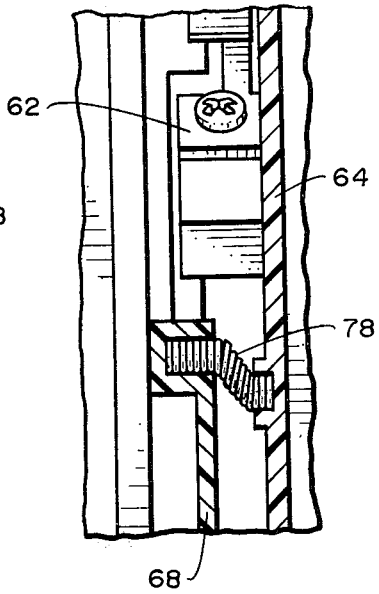
FIG. 7 is a fragmentary, generally vertical sectional view looking in the direction of the arrows 7—7 in FIG. 6.

When in the stationary condition, the control spring 78 is moderately warped as shown in FIG. 7 resiliently urging the ratchet driven wheel 64 and the roll driver collar 68 to circumferentially shift relative to each other into the position shown in FIG. 6 wherein the radial cam 72 on the roll drive collar 68 forces the engagement dog 74 of the ratchet driven wheel 64 radially outwardly to firmly engage the surrounding stationary stop ring 76. This not only locks the ratchet drive and driven wheels 60 and 64 against their driving counterclockwise rotation, as viewed in FIG. 6, but more importantly prevents counterclockwise rotation of the roll drive collar 68 due to the jamming between the radial cam 72 on the roll driver collar 68 and the engagement dog 74 on the ratchet driven wheel 64. Upon initiation of the counterclockwise rotation of the ratchet driven and driven wheels 60 and 64 by the previously described downward pivotal movement of the operating lever 42 and rack carriage 44, the ratchet driven wheel 64 initially shifts circumferentially counterclockwise relative to the roll drive collar 68 warping the control spring 78 a greater amount and moving the engagement dog 74 of the ratchet driven wheel 64 circumferentially relative to the angled and radial cams 70 and 72 of the roll drive collar 68 which causes the angled cam 70 to pivotally withdraw the engagement dog 74 from its engagement with the stop ring 76. The radial cam 72 of the roll drive collar 68 due to such circumferential shifting is ultimately circumferentially engaged by its adjacent ratchet 62 of the ratchet driven wheel 64 so that the roll drive collar 68 is rotated counterclockwise by the ratchet driven wheel 64. The anti-milking function of all of these described locking, relative circumferential shifting and rotations will be hereinafter described more in detail after a description of the remaining structure of the dispenser.

As shown in FIG. 5, the roll drive collar 68 is secured to an end plug 80 rotatably mounted on a stub shaft 82 projecting inwardly from the operating device 38, the end plug 80 being secured in the end of a drive tube or hollow rod 84. As shown in FIG. 2, the drive tube or hollow rod 84 extends nearly the entire width of the case 20 with the opposite end thereof being similarly stub shaft rotatably supported on the opposite case end wall 28. Thus, all rotation of the roll drive collar 68 transmitted from the operating device 38 will directly rotate the drive rod 84.

First and second dispensing rolls 86 and 88 are independently rotatably mounted telescoping the drive rod 84 having their generally central common ends 90 and 92 spaced axially apart generally rearwardly aligned with a case central partition 94 as best seen in FIG. 2. The dispensing roll common ends 90 and 92 have centrally facing, axially grooved drive rings 96 and 98 respectively secured thereto as shown, for instance, in FIGS. 2 and 10. An axially shiftable actuating device generally indicated at 100 is mounted centrally between the first and second dispensing rolls 86 and 88 and includes a clutch spool 102 telescoping the drive rod 84.

Figure 10:
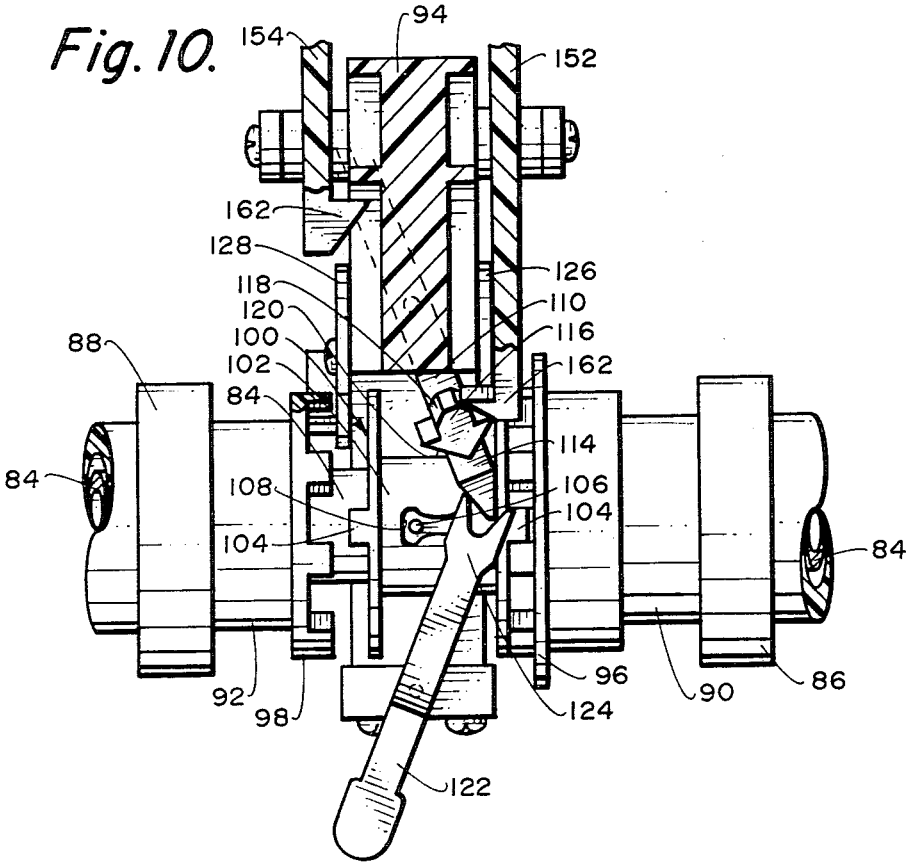
FIG. 10 is a fragmentary, horizontal sectional view looking in the direction of the arrows 10—10 in FIG. 9.
Figure 9:
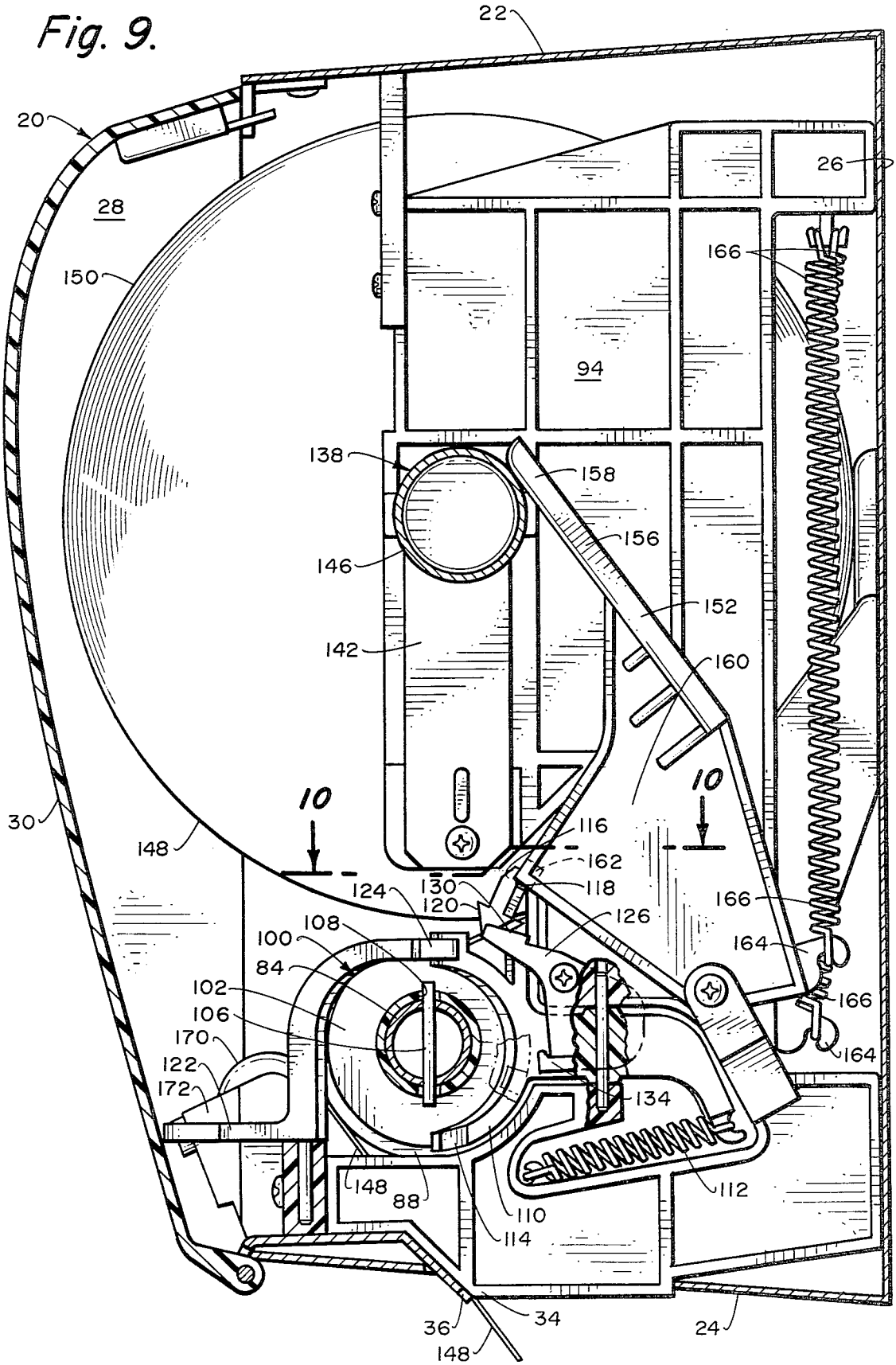
FIG. 9 is an enlarged, vertical sectional view looking in the direction of the arrows 9—9 in FIG. 2.
Figure 11:
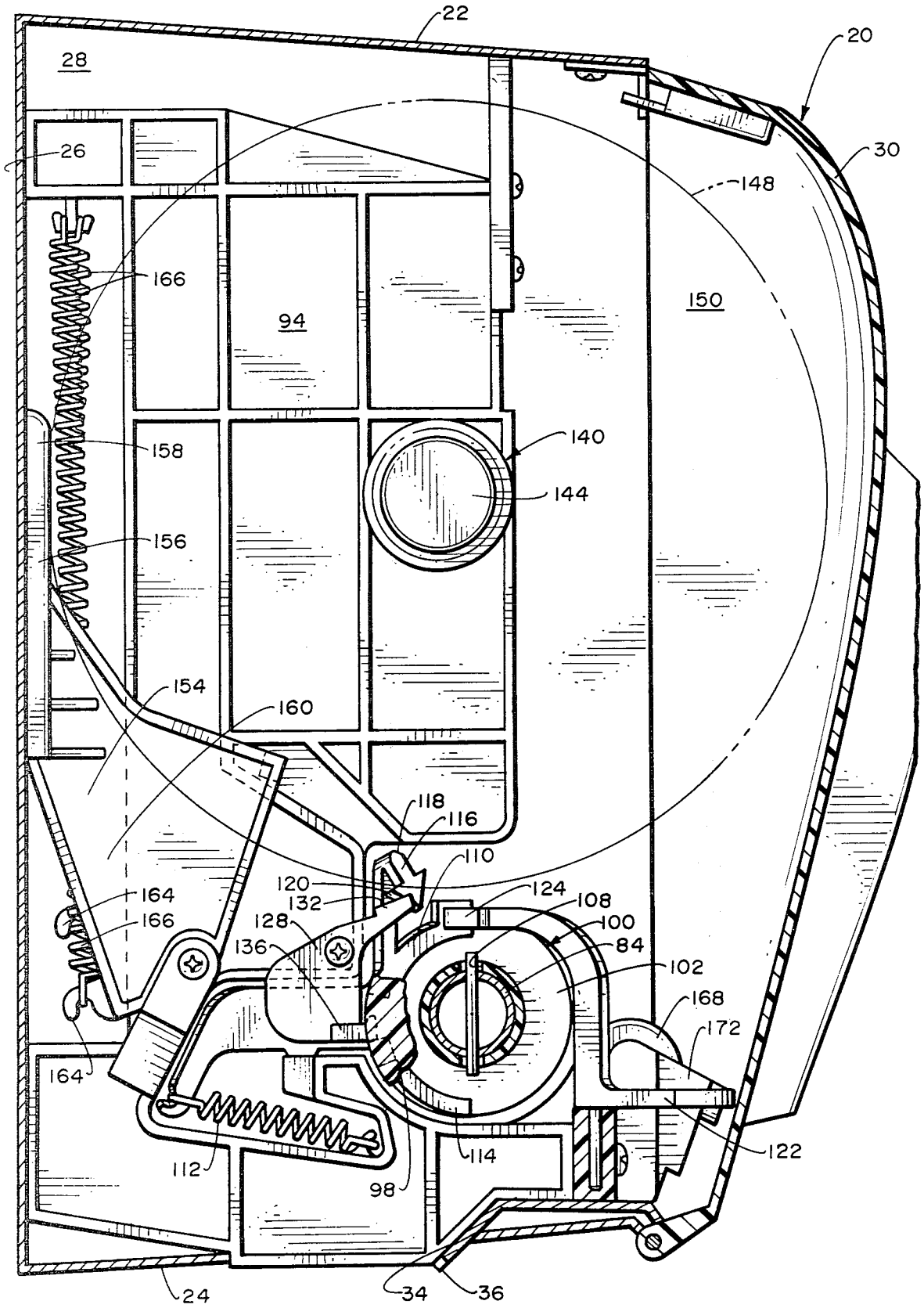
FIG. 11 is an enlarged, vertical sectional view looking in the direction of the arrows 11—11 in FIG. 2.

The clutch spool 102 has oppositely axially extending drive tabs 104 formed at opposite axial sides preferably at diametrically opposed locations. These drive tabs 104 are properly dimensioned and properly circumferentially located on the clutch spool 102 for axial reception in either of the grooved drive rings 96 or 98. Furthermore, the clutch spool 102 is axially dimensioned such that it is alternately axially shiftable into driving engagement with either of the first and second dispensing rolls 86 or 88 while being totally drivingly disengaged or free of engagement with the other of the first and second dispensing rolls. As best seen in FIGS. 9 and 10, the clutch spool 102 is drivingly connected rotatable at all times with the drive rod 84 while still being permitted to shift axially relative thereto by a diametrical drive pin 106 of the drive rod having the ends thereof received through axially elongated drive slots 108 of the clutch spool.

Referring to FIGS. 2 and 9 through 14, the actuating device 100 also includes a shuttle 100 horizontally pivotally mounted on and pivotal horizontally through the case central partition 94, alternate horizontal over-center pivotal positions thereof being controlled by a rearward end engaged tension spring 112. A C-shaped forward shifting end 114 of the shuttle 110 is horizontally movably engageable with diametrically opposite upper and lower portions of the clutch spool 102 horizontally centrally captive within the clutch spool as shown, for instance, in FIGS. 9 and 10. Rearwardly adjacent the forward shifting end 114, the shuttle 110 is formed with an upstanding positioner portion 116 having oppositely angled sensor engagement surfaces 118 at an upper extremnity thereof and oppositely angled anti-milk engagement surfaces 20 at a forward-downward portion thereof, the sensor engagement surfaces 118 facing generally upwardly and the anti-milk engagement surfaces 120 facing generally downwardly as shown.

Thus, with the control spring 112 always urging the rearward end of the shuttle 110 to pivot forwardly at either side of the case central partition 94 and with the shuttle forward shifting end 114 positioned engageable in either axial direction with the clutch spool 102, movement of the shuttle forward shifting end 114 in either pivotal direction, to the right or left as viewed in FIG. 2, will shift the clutch spool in that direction along the drive rod 84 and into driving engagement with the dispensing roll 86 or 88 at that side while completely disengaging from the other dispensing roll. Furthermore, since this is obviously an over center positioning by the control spring 112 in either direction (FIGS. 10 and 13), the shuttle 110 and the clutch spool 102 with always remain in the particular side pivoted position until urged therefrom by sufficient outside force. A manual shifting level 122 is pivotally mounted on the case central partitions 94 forwardly of the clutch spool 102 (FIGS. 10 and 13) with a rearward U-shaped end 124 pivotally controllably receiving the upper forward end portion of the shuttle forward shifting end 114 so that the shuttle 110 and, therefore, the clutch spool 102 may be manually shifted in either direction as will be hereinafter explained more in detail.

Secondary anti-milking members 126 and 128 are vertically pivotally mounted upon the case central partition 94 rearwardly aligned with the drive rings 96 and 98 of the first and second dispensing rolls 86 and 88, respectively, as shown in FIGS. 9, 11, 12 and 14. The secondary anti-milking members 126 and 128 are formed with upper end pressure surfaces 130 and 132, respectively, and lower end stop lugs 134 and 136, respectively. It will be particularly noted that the secondary anti-milking members 126 and 128 are pivotally mounted about pivot axis located toward upper portions thereof with the majority of the masses thereof below and behind the pivot axis so that the same are counter weighted tending to pivot the stop lugs 134 and 136 generally forwardly and into engagement with the respective of the drive rings 96 and 98 of the first and second dispensing rolls 86 and 88.

Without anything otherwise interfering, therefore, the counter weighting of the secondary anti-milking members 126 and 128 automatically causes them to pivot the stop lugs 134 and 136 forwardly into engagement with the drive rings 96 and 98 of the first and second dispensing rolls 86 and 88. However, when the shuttle 110 is pivotally shifted toward a particular of the first and second dispensing rolls 86 and 88 shifting the clutch spool 102 in that direction, the anti-milk engagement surface 120 at that shuttle side will progressively engage the pressure surface 130 or 132 of that secondary anti-milking member 126 or 128 and pivot the secondary anti-milking member out of engagement with the particular dispensing roll drive ring 96 or 98.

As best seen in FIGS. 2, 9, 11 and 12, first and second roll holders generally indicated at 138 and 140 are mounted spaced upwardly of the first and second dispensing rolls 86 and 88 between the case end walls 28 and the case central partition 94, the first roll holder 138 being radially aligned with the first dispensing roll 86 and the second roll holder 140 being radially aligned with the second dispensing roll 88. The first and second roll holders 138 and 140 are generally of conventional construction each including an axially resiliently urged end holder 142 and and axially stationary end holder 144 for reception in the hollow ends of a tubular core 146 having a web of material, in this case a paper toweling web 148, continuously wound thereon and forming the paper toweling rolls generally indicated at 150. For purposes of certain of the improvements of the present invention, the tubular cores 146 of each of the paper toweling rolls 150 are so called "split" or "separable" cores, that is, in preferred form, each core is composed of at least two core parts which are completely radially separable one axially separated from the other at a generally radial plane somewhere intermediate the overall axial length of the particular tubular core, preferably approximately midway as shown. The separable tubular cores 146 are retained in roll assembly merely by the paper towelling web 148 being continuously wound thereon so that when the paper towelling web is substantially totally depleted by unwinding the same from the tubular core, there is no longer anything to retain the parts of the tubular core aligned and they can radially separate, all for a purpose to be hereinafter described.

As best seen in FIGS. 2 and 9 through 14, first and second sensors 152 and 154 are vertically pivotally mounted, one at either side of the case central partition 94, the purpose thereof being for sensing the paper towelling web 148 of the particular paper towelling roll 150 supported on that roll holder 138 or 140. As shown, the first and second sensors 152 and 154 are substantially identical except that one is a mirror image of the other. Each includes a generally horizontal sensing portion 156 terminating spaced from the case central partition 94 in a sensing tongue 158. Furthermore, each includes a generally vertical mounting portion 160 terminating downwardly and spaced forwardly of the pivot axis in an angled shuttle engagement tab 162, and terminating downwardly spaced rearwardly of the pivot axis in a spring connecting lug 164. Each of the sensor spring connecting lugs 164 has a generally vertically upward tension spring 166 engaged therewith, the upper end of the tension spring being secured near the upper extremity of the case central partition 94. Thus, each of the first and second sensors 152 and 154 is resiliently urged to pivot the sensing tongue 158 thereof forwardly and arcuately downwardly relative to the dispenser case 20 and the paper towelling rolls 150 mounted therein, the functioning of the sensors and their relationship to the other components of the dispenser to be best described and understood in the following description of the overall operation of the dispenser.

The only additional functional elements remaining for a proper functioning of the preferred embodiment of the dispenser of the present invention are the somewhat usual first and second pressure rolls 168 and 170. As best seen in FIGS. 2, 9, 11 and 12, the first and second pressure rolls 168 and 170 are mounted forwardly of and preferably axially centrally of the first and second dispensing rolls 86 and 88, respectively. These first and second pressure rolls 168 and 170 are substantially identical and are each rotatably mounted on a pivotal roll frame 172 which is resiliently urged to pivot rearwardly toward the particular dispensing roll 86 or 88 thereby constantly rearwardly urging the particular pressure roll into constant resilient engagement with the particular dispensing roll.

In overall operation of the preferred embodiment of dispenser, the case front wall 30 would first be opened and two full, separable core, paper towelling rolls 150 installed therein, one in each of the first and second roll holders 138 and 140. During such paper towelling roll installation, each of the first and second sensors 152 and 154 would be forced pivotally rearwardly generally to the position of the second sensor 154 shown in FIG. 11 and pivotally fowardly resiliently engaging and sensing the particular paper towelling web 148 of the particular paper towelling roll 150. The paper towelling rolls 150 would preferably be installed positioned for unwinding of the paper towelling web 148 therefrom downwardly and forwardly therefrom as illustrated in FIG. 9. Furthermore, the paper towelling web 148 of each roll 150 would be directed forwardly over the particular dispensing roll 86 or 88, downwardly between that dispensing roll and its pressure roll 168 or 170 and finally slightly rearwardly and downwardly exiting the dispenser case 20 through the dispenser slot 34 along the tear-off edge 36 as also illustrated in FIG. 9.

Assuming that initial dispensing will be from the paper towelling roll 150 in the first roll holder 138 by the first dispensing roll 86 and the other paper towelling roll will remain free of dispensing therefrom as a reserve roll, the clutch spool 102 of the actuating device 100 will be shifted to the right as viewed in FIG. 2 and as shown, for instance, in FIGS. 2 and 10. If the clutch spool 102 is originally in the left hand position, this shifting can be accomplished by manipulation of the manual shifting lever 122 and this, of course, will likewise properly shift the shuttle 110. Furthermore, during this clutch spool shifting, the first secondary anti-milking member 126 will have its pressure surface 130 engaged by the shuttle anti-milk engagement surface 120 to pivot its stop lug 134 out of engagement with the first dispensing roll 86 while releasing the second secondary anti-milking member 128 to automatically pivot into engagement with the second dispensing roll 88 thereby locking the second dispensing roll against rotation and any possible milking of the paper towelling web 148 engaged therewith from its paper towelling roll 150. The dispenser is now prepared for dispensing and the case 20 is closed.

Thereafter, dispensing of the paper towelling web 148 from the paper towelling roll 150 in the right hand or first roll holder 138 may be accomplished by downward reciprocation of the operating lever 42 from its upper position shown in FIG. 3 down to its lower position shown in FIG. 8 with release permitting it to be resiliently moved back upwardly again to its upper position. The downward portion of the reciprocal stroke will carry the rack carriage 44 downwardly rotating the pinion 58 and this rotatable motion will be transmitted through the primary anti-milking device 66 into the drive rod 84, from the drive rod into the clutch spool 102 and ultimately into the first dispensing roll 86. This, thereby, causes the first dispensing roll 86 to pull the paper towelling web 148 from the paper towelling roll 150 in the first roll holder 138 and project a length of the same from the right hand side of the dispenser slot 34 where it can be torn off by use of the tear-off edge 36.

During the return upward movement of the operating lever 42 from the position shown in FIG. 8 to the position shown in FIG. 3, the pinion 58 will be rotated in the reverse lost motion direction by the rack carriage 44 so that the first dispensing roll 86 will remain stationary and no paper towelling web 148 will be dispensed. As previously described, when the operating lever 42 is in its upper stationary position as shown in FIG. 3, or when the operating lever is moving upwardly in its return stroke, in either case no rotation being transmitted from the operating device 38 through the primary anti-milking device 66, this anti-milking device will remain in its stationary locked position shown in FIG. 6 preventing any rotation of the first dispensing roll 86 and consequently any milking of the paper towelling web 148 therefrom. Immediately upon initiation of rotation from the operating device 38 through the primary anti-milking device 66, the engagement dog 74 pivots radially inwardly from the position shown in FIG. 6 to permit the transmittal of rotation by the primary anti-milking device 66 and, therefore, the rotation of the first dispensing roll 86. However, if during this transmittal of rotation through the primary anti-milking device 66 and the dispensing of the paper towelling web 148 by the first dispensing roll 86, the paper towelling web being dispensed is grasped and an attempt is made to pull it ahead of the rotation of the first dispensing roll, this attempted overrunning rotational force will be transmitted back to the primary anti-milking device 66 causing the same to immediately lock as hereinbefore described to thereby again prevent milking.

Normal dispensing of the paper towelling web 138 from the paper towelling roll 150 in the first roll holder 138 can continue in the same manner until the paper towelling web is substantially depleted releasing the separable tubular core 146 of that roll. As shown in FIGS. 2 and 9, the first sensor 152 has continued to sense the paper towelling web 148 of that paper towelling roll 150 down to or radially inwardly to that separable tubular core 146 which at the moment shown has not yet separated. The continued radial pressure of the first sensor 152, however, will immediately radially separate the separable tubular core 146 by its combined forward and downward pressure thereon causing the first sensor to pivot radially downwardly through the first roll holder 138 approaching the position shown in FIG. 12 with the now separating core parts being somewhat ejected to the forward lower part of the dispenser case 20 as shown in phantom lines in FIG. 12 due to the pivotal resilient urging of the particular sensor. In other words, the forward-downward resilient urging and movement of the sensor against the one core part applies the same pressure through their axis engagement to the other core part somewhat ejecting both forwardly and downwardly to the forward lower corner of the case forwardly of the particular dispensing roll. As an important adjunct, thereafter when the next dispenser maintenance operation is performed by opening the case front wall 30, these scrap core parts will fall outwardly and be disposed of rather than left in the case.

Figure 12:
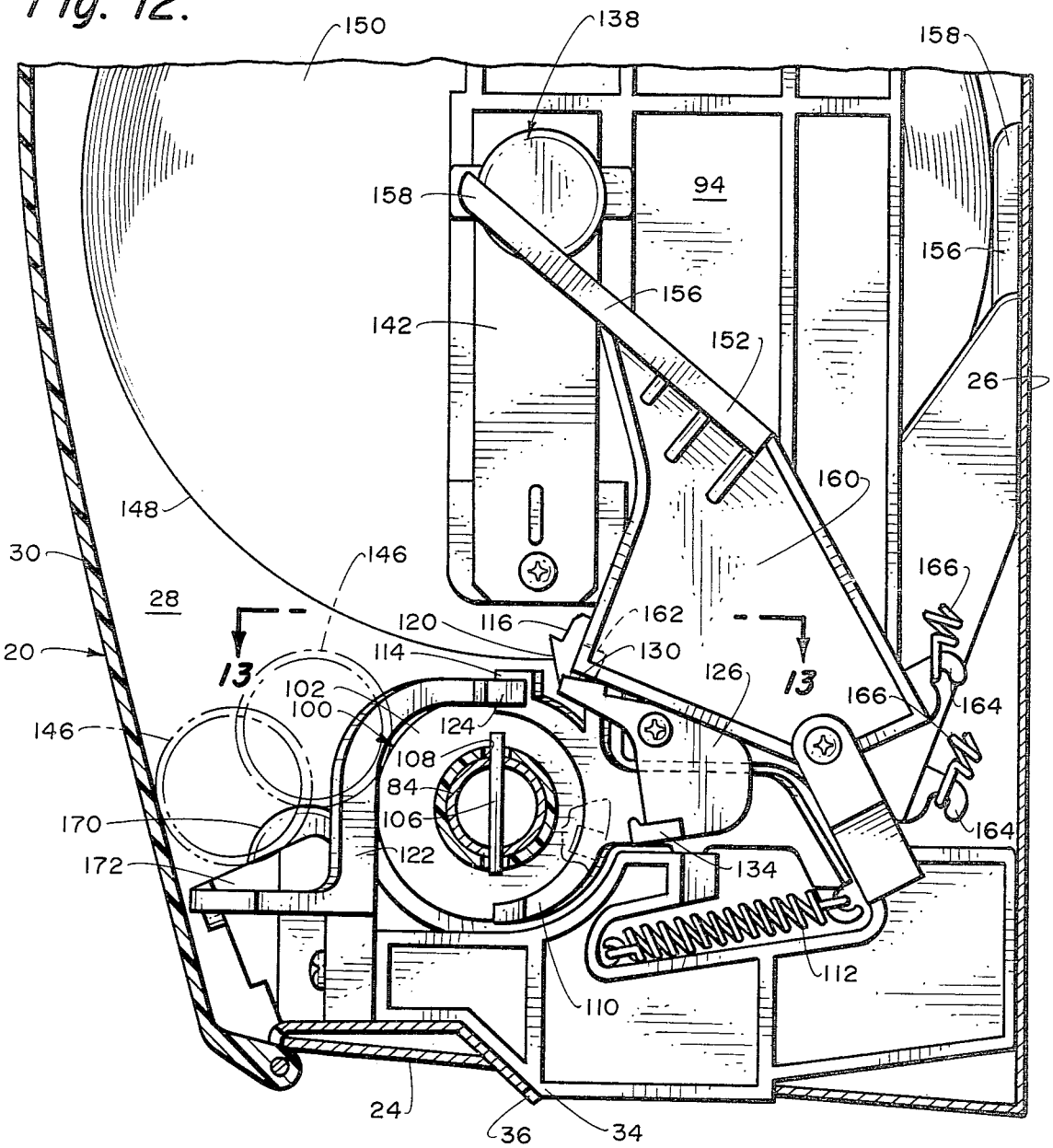
FIG. 12 is a fragmentary, vertical sectional view similar to FIG. 9, but with the dispenser having automatically shifted from dispensing the web of the first web supply roll to dispensing the web of the second web supply roll after depletion of the first web supply roll.
Figure 13:
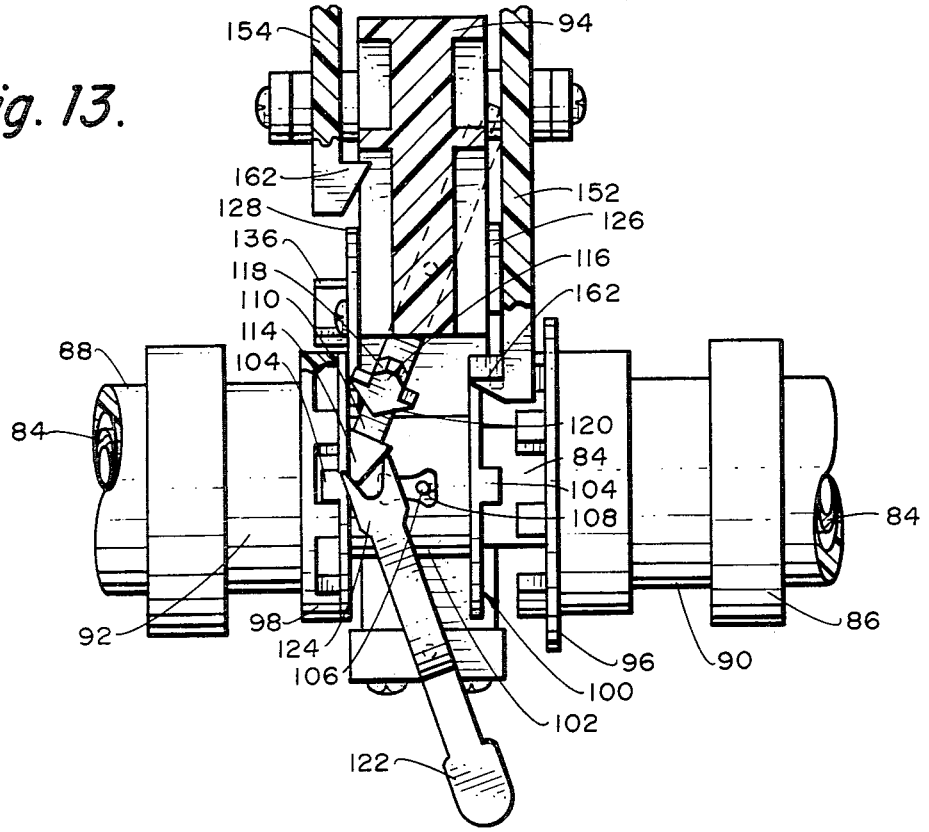
FIG. 13 is a fragmentary, horizontal sectional view looking in the direction of the arrows 13—13 in FIG. 12.
Figure 15:
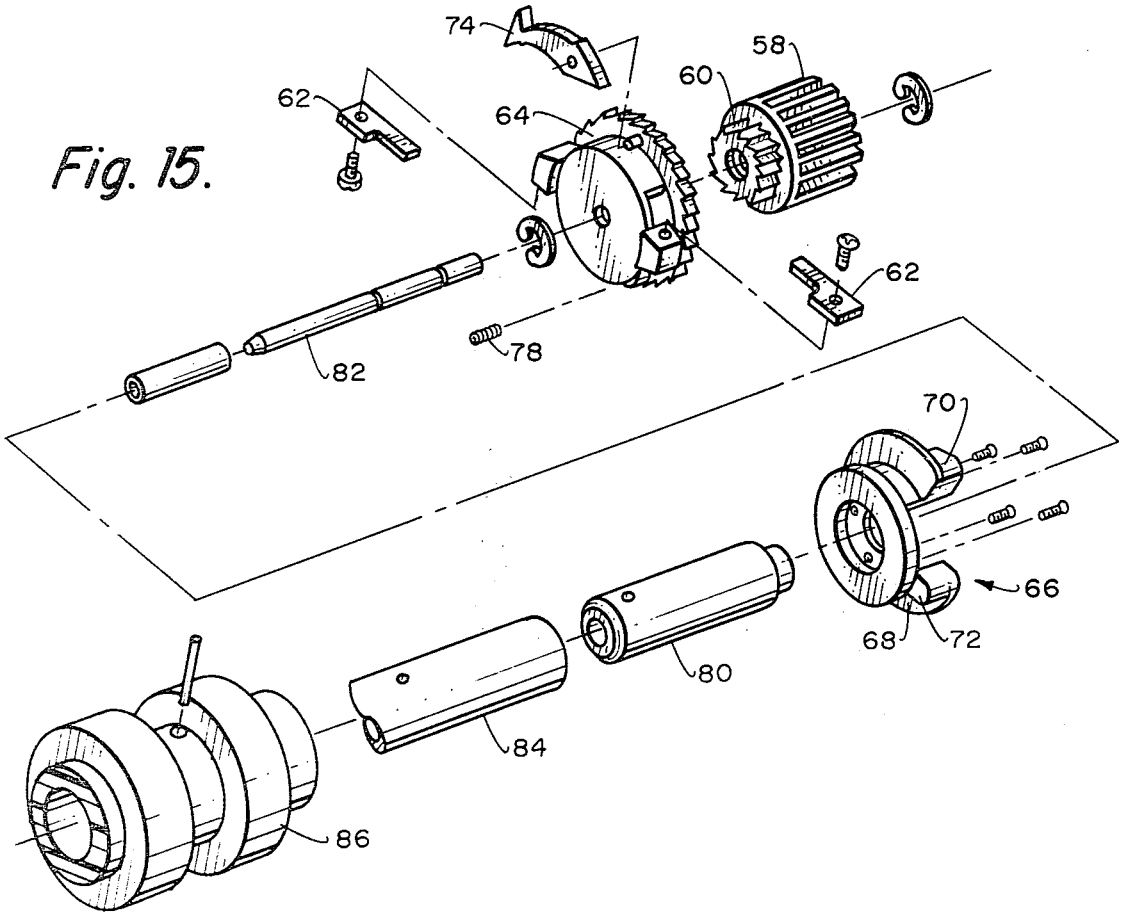
FIG. 15 is an exploded view of part of the drive assembly of the dispenser.
Figure 14:
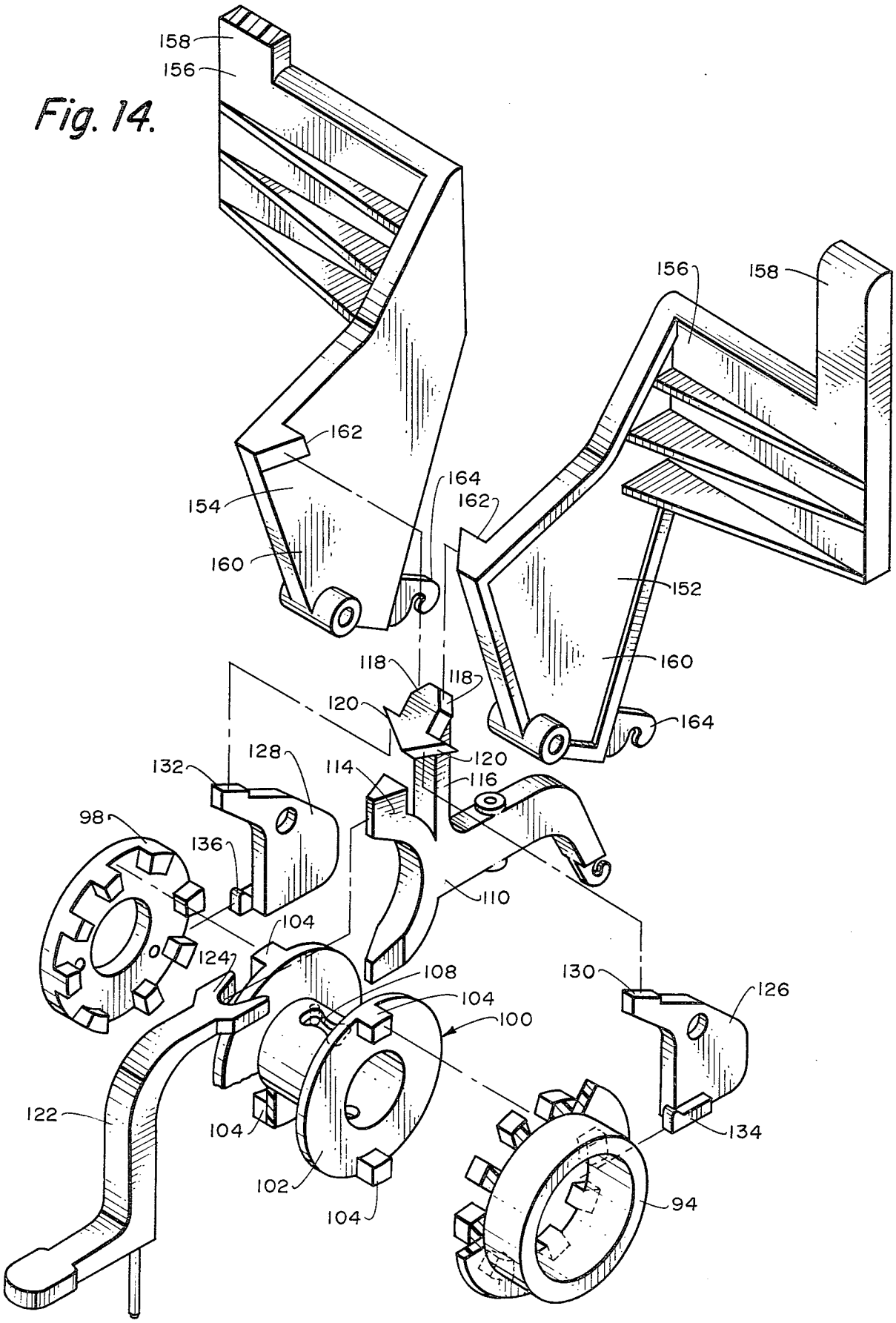
FIG. 14 is an enlarged, exploded view showing the dispenser web sensing and drive shifting assemblies of the dispenser.

As the first sensor 152 finally moves into its downward pivoted position shown in FIG. 12, the shuttle engagement tab 162 thereof will engage and move angularly downwardly along the sensor engagement surface 118 at that side of the shuttle 110 pivotally shifting the shuttle from its right hand position shown in FIG. 10 to its left hand position shown in FIG. 13 causing the forward shifting end 114 to axially shift the clutch spool 102 from engagement with the first dispensing roll 86 into engagement with the second dispensing roll 88 releasing the first dispensing roll. This shifting of the shuttle 110 also causes the anti-milk engagement surface 120 thereof at the left hand side of its positioner portion 116 to engage the pressure surface 132 of the second secondary anti-milking member 128 pivoting the stop lug 136 of that anti-milking member out of engagement with the second dispensing roll 88 so that the second dispensing roll is now drivingly engaged by the clutch spool 102 and is free for rotation thereby. As an incidental matter, the first sensor 152 ultimately comes to rest downwardly against the first secondary anti-milking member 126 pivoting the same out of engagement with the first dispensing roll 86 with the components thus remaining until a replenished paper towelling roll 150 is installed in the first roll holder 138, but this is of no consequence since until replenished, there is no paper towelling roll in the first roll holder that could be milked. More importantly, since the dispensing of a paper towelling web 148 has now been automatically shifted to that of the paper towelling roll 150 which is the reserve roll in the second roll holder 140, the dispenser can be continued to be operated to dispense the paper towelling web from the left hand side thereof as viewed in FIG. 2.

Due to the fact that both the first sensor 152 at the right hand side and the second sensor 154 at the left hand side have been provided, thereby adapting the dispenser of the present invention to automatic shifting both from right to left and left to right, it is only necessary during the dispensing of the reserve paper towelling roll 150 in the second roll holder 140 to replenish the paper towelling roll in the first roll holder 138. If this is done, as soon as the second sensor 154 senses depletion of the reserve paper towelling roll 150 in the second roll holder 140, it will function in the same manner as above described relative to the first sensor 152. This will automatically shift the clutch spool 102 from driving engagement with the second dispensing roll 88 into driving engagement with the first dispensing roll 86 so that dispensing of a paper towelling web 148 can continue from the replenished paper towelling roll 150 in the first roll holder 138. Repeating this procedure at the appropriate times will obviously always maintain the dispenser sufficiently full of the paper towelling webs 148 for uninterrupted dispensing even though these maintenance operations will be far less frequently required.

According to the dispenser construction and method princples of the present invention, therefore, as applied generally to the dispensing of paper towels and the like from continuously wound rolls thereof, a dual continuous web dispenser is provided in the form of a dual roll towel dispenser wherein a first towelling roll is dispensed while a second towelling roll remains idle and free of dispensing. Upon the first towelling roll being substantially depleted as automatically sensed by the dispenser, the dispensing is automatically shifted to the second towelling roll so that the same dispensing can continue to take place without interruption. Thus, with appropriate maintenance operations for replenishment of towelling rolls at appropriate times, not only can uninterrupted dispensing of towelling take place, but every towelling roll is substantially completely used without the incidence of waste. Furthermore, although the sophistication of the dispenser will determine the complication of the maintenance operation and in the dispenser more sophisticated form will be exceedingly simple, such maintenance operations, regardless of the type, will be less frequently required while still providing dispensing at all times.

Additionally, according to certain of the dispenser improvements of the present invention, the proper sensing of depleted towelling rolls in the dispenser is more positively insured by the integration into the dispenser of separable core rolls of towelling. With the separable core rolls, substantial depletion of the towelling of each roll is insured before the cores thereof can separate and by using this core separation as the towelling depletion signal, the proper timing thereof is always indicated on a more positive basis so that, again, the waste of towelling is eliminated. Still additionally, due to a particular novel cooperation between the towelling roll sensors and the depleted roll core parts in the preferred form, the core parts upon depletion are ejected to the forward lower corner of the case, where they will virtually fall out of the case when the front case wall is opened insuring proper removal and disposal during a maintenance operation. As a still further additional feature, certain anti-milking principles applied to the preferred dual roll towel dispenser according to the present invention virtually eliminate the possibility of milking the paper towelling from the towelling rolls regardless of the position of the towelling roll, that is, whether then being dispensed or whether then in an idle or reserve position awaiting subsequent dispensing, the anti-milking improvements likewise contributing to the overall efficient operation and towelling waste elimination of the present invention.

We claim:

1. In a dispensing device of the type having a first roll rotatable to dispense a first continuous web of material engaged therewith from a first web supply and a second roll rotatable to dispense a second continuous web of material engaged therewith from a second web supply; the improvements comprising: operating means operably connectable to each of said first and second rolls for rotating said rolls; shiftable actuating means initially shifted operably connecting said operating means to said first roll for said operating means rotation of said first roll to dispense said first web from said first web supply while said second roll remains operably disconnected from said operating means and free of dispensing said second web; sensing means operably engaged with said first web for continuously sensing said first web during dispensing thereof to ultimately sense substantially depletion of said first web supply and then automatically shifting said actuating means to operably connect said operating means to said second roll for said operating means rotation of said second roll to dispense said second web from said second web supply while said first roll remains operably disconnected from said operating means.

2. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means.

3. In a dispensing device as defined in claim 1 in which said first and second rolls are axially aligned rolls.

4. In a dispensing device as defined in claim 1 in which said operating means includes a single operating device alternately operably connectable to each of said first and second rolls for rotating said rolls.

5. In a dispensing device as defined in claim 1 in which said first and second web supplies are first and second rotatably mounted rolls of material with said first and second webs continuously wound thereon and extending continuously therefrom, each of said web supply rolls having separable core means retained in roll assembly by said continuous web of material being wound thereon and radially separating upon said continuous web of material being substantially totally unwound therefrom to substantially deplete that web supply roll; and in which said sensing means includes a sensor continuously engaged with said first web at periphery of said first web supply roll, said sensor being movable radially through and separating said separable core means of said first web supply roll upon said substantial depletion of said first web supply and then automatically shifting said actuating means to operably connect said operating means to said second roll for said operating means rotation of said second roll to dispense said second web from said second web supply roll while said first roll remains operably disconnected from said operating means.

6. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; in which said first and second web supplies are first and second rotatably mounted rolls of material with said first and second webs continuously would thereon and extending continuously therefrom, each of said web supply rolls having separable core means retained in roll assembly by said continuous web of material being wound thereon and radially separating upon said continuous web of material being substantially totally unwound therefrom to substantially deplete that web supply roll; and in which said first sensing means includes a first sensor continuously engaged with said first web at periphery of said first web supply roll and said second sensing means includes a second sensor continuously engaged with said second web at periphery of said second web supply roll, each of said sensors being movable radially through and separating the particular of said separable core means of the particular of said web supply roll upon substantial depletion of the particular of said web supply and then automatically shifting said actuating means to operably connect said operating means to the other of said first and second rolls for said operating means rotation of the other of said rolls to dispense the web of that web supply roll while the roll from which said actuating means has automatically shifted remains operably disconnected from said operating means.

7. In a dispensing device as defined in claim 1 in which anti-milking means is operably connected to said second roll during said actuating means being initially shifted operably connecting said operating means to said first roll for positively preventing rotation of said second roll during said operable connection thereto, said anti-milking means being automatically operably disconnected from said second roll permitting rotation of said second roll upon said sensing means shifting said actuating means to operably connect said operating means to said second roll.

8. In a dispensing device as defined in claim 1 in which primary anti-milking means is operably connected to said operating means for positively preventing during lack of rotation by said operating means rotation of the particular of said first and second rolls to which said operating means is operably connected as caused by forces on the particular web of that particular roll tending to rotate that particular roll, said primary anti-milking means also being automatically actionable for positively preventing increased rotation of that particular roll ahead of its normal rotation by said operating means upon forces being applied to the web of that particular roll tending to cause said increased roll rotation; and in which secondary anti-milking means is operably connected to each of said first and second rolls positively preventing rotation of the particular roll when said operating means is free of operable connection to that particular roll and being automatically disconnected from that particular roll when said sensing means shifts said actuating means to operably connect said operating means to that particular roll.

9. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; and in which anti-milking means is operably connected alternately to each of said first and second rolls when that particular roll is free of operable connection to said operating means for positively preventing rotation of that particular roll, said anti-milking means being automatically operably disconnected from each of said first and second rolls for permitting rotation of that particular roll when said operating means is operably connected to that particular roll for rotating the same.

10. In a dispensing device as defined in claim 1 in which primary anti-milking means is operably connected to said operating means for positively preventing during lack of rotation by said operating means rotation of the particular of said first and second rolls to which said operating means is operably connected as caused by forces on the particular web of that particular roll tending to rotate that particular roll, said primary anti-milking means also being automatically actionable for positively preventing increased rotation of that particular roll ahead of its normal rotation by said operating means upon forces being applied to the web of that particular roll tending to cause said increased roll rotation; in which secondary anti-milking means is operably connected to each of said first and second rolls positively preventing rotation of the particular roll when said operating means is free of operable connection to that particular roll and being automatically disconnected from that particular roll when said sensing means shifts said actuating means to operably connect said operating means to that particular roll; and in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means.

11. In a dispensing device as defined in claim 1 in which said actuating means includes shiftable clutch means alternately positively engageable with each of said first and second rolls for transmitting rotation from said operating means to that particular roll.

12. In a dispensing device as defined in claim 1 in which said actuating means includes shiftable clutch means alternately positively engageable with each of said first and second rolls for transmitting rotation from said operating means to that particular roll, shuttle means operably engageable with said clutch means and operably engageable by said sensing means for said sensing means through said shuttle means shifting said clutch means from engagement with said first roll to engagement with said second roll.

13. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; and in which said actuating means includes shiftable clutch means alternately positively engageable with each of said first and second rolls for transmitting rotation between said operating means and the particular roll to which it is connected, shuttle means operably engageable with said clutch means and operably engageable by each of said first and second sensing means for said automatic shifting of said actuating means to operably connect said operating means to alternately rotate said first and second rolls.

14. In a dispensing device as defined in claim 1 in which said actuating means includes shiftable clutch means alternately positively engageable with each of said first and second rolls for transmitting rotation from said operating means to that particular roll; and in which a manually operable shift lever is operably engageable with said clutch means for independently shifting said clutch means between engagement with the respective of said first and second rolls.

15. In a dispensing device as defined in claim 1 in which said first and second rolls are axially aligned with said actuating means generally axially between adjacent roll ends; and in which said actuating means includes clutch means shiftable between positive engagement with said first roll while being positively disengaged from said second roll and positive engagement with said second roll while being positively disengaged from said first roll.

16. In a dispensing device as defined in claim 1 in which said first and second rolls are axially aligned with said actuating means generally axially between adjacent roll ends; and in which said actuating means includes clutch means shiftable between positive engagement with said first roll while being positively disengaged from said second roll and positive engagement with said second roll while being positively disengaged from said first roll, shuttle means engageable with said clutch means and engageable by said sensing means for shifting said clutch means from positive engagement with said first roll to positive engagement with said second roll upon said sensing means sensing substantial depletion of said first web supply.

17. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; in which said first and second rolls are axially aligned with said actuating means generally axially between adjacent roll ends; and in which said actuating means includes clutch means shiftable between positive engagement with said first roll while being positively disengaged from said second roll and positive engagement with said second roll while being positively disengaged from said first roll, shuttle means engageable with said clutch means and engageable by either of said sensing means for shifting said clutch means from positive engagement with one roll to positive engagement with the other roll on that particular sensing means sensing substantial depletion of its associated web supply.

18. In a dispensing device as defined in claim 1 in which said first and second rolls are axially aligned with said actuating means generally axially between adjacent roll ends; in which said actuating means includes clutch means shiftable between positive engagement with said first roll while being positively disengaged from said second roll and positive engagement with said second roll while being positively disengaged from said first roll; and in which anti-milking means is operably connected to said second roll during said actuating means being initially shifted operably connecting said operating means to said first roll for positively preventing rotation of said second roll during said operable connection thereto, said anti-milking means being automatically operably disconnected from said second roll permitting rotation of said second roll upon said sensing means shifting said actuating means to operably connect said operating means to said second roll.

19. In a dispensing device as defined in claim 1 in which said first and second rolls are axially aligned with said actuating means generally axially between adjacent roll ends; in which said actuating means includes clutch means shiftable between positive engagement with said first roll while being positively disengaged from said second roll and positive engagement with said second roll while being positively disengaged from said first roll; in which primary anti-milking means is operably connected to said operating means for positively preventing during lack of rotation by said operating means rotation of the particular of said first and second rolls to which said operating means is operably connected as caused by forces on the particular web of that particular roll tending to rotate that particular roll, said primary anti-milking means also being automatically actionable for positively preventing increased rotation of that particular roll ahead of its normal rotation by said operating means upon forces being applied to the web of that particular roll tending to cause said increased roll rotation; and in which secondary anti-milking means is operably connected to each of said first and second rolls positively preventing rotation of the particular roll when said operating means is free of operable connection to that particular roll and being automatically disconnected from that particular roll when said sensing means shifts said actuating means to operably connect said operating means to that particular roll.

20. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; in which anti-milking means is operably connected alternately to each of said first and second rolls when that particular roll is free of operable connection to said operating means for positively preventing rotation of that particular roll, said anti-milking means being automatically operably disconnected from each of said first and second rolls for permitting rotation of that particular roll when said operating means is operably connected to that particular roll for rotating the same; in which said first and second rolls are axially aligned with said actuating means generally axially between adjacent roll ends; and in which said actuating means includes clutch means shiftable between positive engagement with said first roll while being positively disengaged from said second roll and positive engagement with said second roll while being positively disengaged from said first roll.

21. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; in which said first and second rolls are axially aligned with said actuating means generally axially between adjacent roll ends; in which said actuating means includes clutch means shiftable between positive engagement with said first roll while being positively disengaged from said second roll and positive engagement with said second roll while being positively disengaged from said first roll, shuttle means engageable with said clutch means and engageable by each of said first and second sensing means for shifting said clutch means from positive engagement with one roll to positive engagement with the other roll upon the particular sensing means sensing substantial depletion of its particular web supply; in which primary anti-milking means is operably connected to said operating means for positively preventing during lack of rotation by said operating means rotation of the particular of said first and second rolls to which said operating means is operably connected, as caused by forces on the particular web of that particular roll tending to rotate that particular roll, said primary anti-milking means also being automatically actionable for positively preventing increased rotation of that particular roll ahead of its normal rotation by said operating means upon forces being applied to the web of that particular roll tending to cause said increased roll rotation; and in which secondary anti-milking means is operably connected alternately to each of said first and second rolls when that particular roll is free of operable connection to said operating means for positively preventing rotation of that particular roll, said anti-milking means being automatically operably disconnected from each of said first and second rolls for permitting rotation of that particular roll when said operating means is operably connected to that particular roll for rotating the same.

22. In a dispensing device as defined in claim 1 in which said first and second web supplies are first and second rotatably mounted rolls of material with said first and second webs continuously wound thereon and extending continuously therefrom, each of said web supply rolls having separable core means retained in roll assembly by said continuous web of material being wound thereon and radially separating upon said continuous web of material being substantially totally unwound therefrom to substantially deplete that web supply roll; in which said sensing means includes a sensor continuously engaged with said first web at periphery of said first web supply roll, said sensor being movable radially through and separating said separable core means of said first web supply roll upon said substantial depletion of said first web supply and then automatically shifting said actuating means to operably connect said operating means to said second roll for said operating means rotation of said second roll to dispense said second web from said second web supply roll while said first roll remains operably disconnected from said operating means; in which said first and second rolls are axially aligned with said actuating means generally axially between adjacent roll ends; and in which said actuating means includes clutch means shiftable between positive engagement with said first roll while being positively disengaged from said second roll and positive engagement with said second roll while being positively disengaged from said first roll.

23. In a dispensing device as defined in claim 1 in which said sensing means is a first sensing means and a second sensing means is operably engaged with said second web for continuously sensing said second web during dispensing thereof to ultimately sense substantial depletion of said second web supply and upon replenishment of said first web supply then automatically shifting said actuating means to operably connect said operating means to said first roll for said operating means rotation of said first roll to dispense the now replenished first web from the now replenished first web supply while said second roll now remains operably disconnected from said operating means; in which said first and second web supplies are first and second rotatably mounted rolls of material with said first and second webs continuously wound thereon and extending continuously therefrom, each of said web supply rolls having separable core means retained in roll assembly by said continuous web of material being wound thereon and radially separating upon said continuous web of material being substantially totally unwound therefrom to substantially deplete that web supply roll; in which said first sensing means includes a first sensor continuously engaged with said first web at periphery of said first web supply roll and said second sensing means includes a second sensor continuously engaged with said second web at periphery of said second web supply roll, each of said sensors being movable radially through and separating the particular of said separable core means of the particular of said web supply roll upon substantial depletion of the particular of said web supply and then automatically shifting said actuating means to operably connect said operating means to the other of said first and second rolls for said operating means rotation of the other of said rolls to dispense the web of that web supply roll while the roll from which said actuating means has automatically shifted remains operably disconnected from said operating means; in which anti-milking means is operably connected alternately to each of said first and second rolls when that particular roll is free of operable connection to said operating means for positively preventing rotation of that particular roll, said anti-milking means being automatically operably disconnected from each of said first and second rolls for permitting rotation of that particular roll when said operating means is operably connected to that particular roll for rotating the same; in which said first and second rolls are axially aligned rolls with said actuating means generally axially between adjacent roll ends; and in which said actuating means includes clutch means shiftable between positive engagement with said first roll while being positively disengaged from said second roll and positive engagement with said second roll while being positively disengaged from said first roll.

24. In a dispensing device as defined in claim 23 in which said actuating means also includes shuttle means engageable with said clutch means and engageable by each of said first and second sensing means for shifting said clutch means from positive engagement with either of said rolls to positive engagement with the other of said rolls upon either of said sensing means sensing substantial depletion of its particular web supply.

25. In a method of successively dispensing from a dispenser continuous webs of material from web supplies thereof; the steps of: dispensing a first web of material while maintaining a second web of material free of normal dispensing; during said first web dispensing, ultimately automatically sensing substantial depletion of a supply of said first web; upon said sensing of said substantial depletion of said first web supply, automatically shifting for commencing dispensing of said second web.

26. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web.

27. In a method as defined in claim 25 in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; and in which said step of ultimately automatically sensing substantial depletion of said supply of said first web includes ultimately automatically sensing separation of said core of said first web supply roll.

28. In a method as defined in claim 25 in which said steps of dispensing said first web and dispensing said second web include engaging said first web with a rotatable first dispensing roll and engaging said second web with a rotatable second dispensing roll axially aligned with said first dispensing roll.

29. In a method as defined in claim 25 in which said step of dispensing said first web includes maintaining said second web free of said normal dispensing by positively retaining said second web against dispensing movement during said dispensing of said first web.

30. In a method as defined in claim 25 in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web.

31. In a method as defined in claim 25 in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means.

32. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; and in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web.

33. In a method as defined in claim 25 in which said steps of dispensing said first web and dispensing said second web include engaging said first web with a rotatable first dispensing roll and engaging said second web with a rotatable second dispensing roll axially aligned with said first dispensing roll; in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; and in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web.

34. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web; in which said step of dispensing said first web includes maintaining said second web free of said normal dispensing by positively retaining said second web against dispensing movement during said dispensing of said first web; and in which said step of dispensing said second web includes after said replenishing of said supply of said first web, maintaining said first web free of normal dispensing by positively retaining said first web against dispensing movement during said dispensing of said second web.

35. In a method as defined in claim 25 in which said method includes the further steps of: after said commencing dispensing of said second web, replenishing said supply of said first web; during said second web dispensing, ultimately automatically sensing substantial depletion of the supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web; and in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means.

36. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web; in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means; and in which said steps of dispensing said first web and dispensing said second web further include maintaining said second web when not depleted free of said normal dispensing by positively retaining said second web against dispensing movement during dispensing of said first web, and maintaining said first web when not depleted free of said normal dispensing by positively retaining said first web against dispensing movement during said dispensing of said second web.

37. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; and in which said steps of dispensing said first web and dispensing said second web include maintaining said second web when not depleted free of said normal dispensing by positively retaining said second web against dispensing movement during said dispensing of said first web, and maintaining said first web when not depleted free of said normal dispensing by positively retaining said first web against dispensing movement during said dispensing of said second web.

38. In a method as defined in claim 25 in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; and in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means.

39. In a method as defined in claim 25 in which said method includes the further steps of: after said commencing dispensing of said second web, replenishing said supply of said first web; during said second web dispensing, ultimately automatically sensing substantial depletion of said supply of said second web; upon said sensing of said substantial depletion of said second web supply, automatically shifting for commencing dispensing of the now replenished first web; and in which said steps of dispensing said first web and dispensing said second web include engaging said first web with a rotatable first dispensing roll and engaging said second web with a rotatable second dispensing roll, operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means, maintaining said second web when not depleted free of said normal dispensing by positively retaining said second dispensing roll against dispensing movement during said dispensing of said first web, maintaining said first web when not depleted free of said normal dispensing by positively retaining said first dispensing roll against dispensing movement during said dispensing of said second web.

40. In a method as defined in claim 25 in which said steps of dispensing said first web and dispensing said second web include engaging said first web with a rotatable first dispensing roll and engaging said second web with a rotatable second dispensing roll axially aligned with said first dispensing roll; in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web; in which said step of dispensing said first web includes maintaining said second web free of said normal dispensing by positively retaining said second web against dispensing movement during said dispensing of said first web; and in which said step of dispensing said second web includes after said replenishing of said supply of said first web, maintaining said first web free of normal dispensing by positively retaining said first web against dispensing movement during said dispensing of said second web.

41. In a method as defined in claim 25 in which said steps of dispensing said first web and dispensing said second web include engaging said first web with a rotatable first dispensing roll and engaging said second web with a rotatable second dispensing roll axially aligned with said first dispensing roll; in which said method includes the further steps of: after said commencing dispensing of said second web, replenishing said supply of said first web; during said second web dispensing, ultimately automatically sensing substantial depletion of a supply of said second web; upon said sensing of said substantial depletion of said second web supply, automatically shifting for commencing dispensing of the now replenished first web; in which said steps of dispensing said first web and dispensing said second web include dispensing said first web from a continuously wound supply roll of said first web and dispensing said second web from a continuously wound supply roll of said second web with each of said rolls having a separable center core retained in assembly by said web of said roll and being separable upon substantial depletion of said web; in which said step of ultimately automatically sensing substantial depletion of said supply of said first web includes ultimately automatically sensing separation of said core of said first web supply roll during said dispensing of said first web and ultimately automatically sensing separation of said core of said second web supply roll during said dispensing of said second web; and in which said steps of dispensing said first web and dispensing said second web include operably connecting operating means to said first dispensing roll and activating said operating means for rotating said first dispensing roll to dispense said first web, disconnecting said operating means from said first dispensing roll and operably connecting said operating means to said second dispensing roll and then activating said operating means for rotating said second dispensing roll to dispense said second web, maintaining said first and second dispensing rolls when operably connected to said operating means free of rotation except by said operating means and free of rotation at a rate greater than directly by said operating means, maintaining said second web free of said normal dispensing by positively retaining said second web against dispensing movement during said dispensing of said first web, maintaining said first web free of normal dispensing after said replenishing of said supply of said first web by positively retaining said first web against dispensing movement during said dispensing of said second web.

42. In a dispensing device of the type having a hollow case with a generally vertical front wall and enclosing a roll holder positioned axially parallel to the case front wall spaced rearwardly thereof, the roll holder opposite ends supporting parts of a radially separable core of a supply roll having a continuous web of material wound on the core for dispensing therefrom and retaining the core parts in axially aligned roll assembly until depleted, the core being free to radially separate upon substantial depletion of the material web, a sensor generally radially movable relative to the supply roll and bearing resiliently against the material web thereof, the sensor generally radially engaging and separating the core parts upon the material web substantial depletion; the improvements comprising: means mounting said sensor normally positioned generally rearwardly of said supply roll resiliently urging said core parts generally forwardly upon said material web substantial depletion causing said core parts to leave said roll holder generally forwardly and ultimately come to rest generally at a front lower corner of said case.

43. In a dispensing device as defined in claim 42 in which said means mounting said sensor includes means mounting said sensor forwardly and downwardly pivotal resiliently urging said core parts forwardly and downwardly for ultimately coming to rest generally at a front lower corner of said case.

44. In a dispensing device as defined in claim 42 in which means mounts said case front wall selectively forwardly opening exposing said core parts that have come to rest at said front lower corner of said case for convenient removal of said core parts.

45. In a dispensing device as defined in claim 42 in which there are certain components of said dispensing device at said front lower corner of said case so as to support said core parts which come to rest at said case front lower corner spaced above lower extremities of said case front wall; and in which said case front wall is a generally forwardly opening front wall and may be selectively opened for permitting said core parts which have come to rest at said front wall to fall out of said case by gravity.

46. In a dispensing device as defined in claim 42 in which said means mounting said sensor includes means mounting said sensor forwardly and downwardly pivotal forcing said core parts generally forwardly and downwardly upon said material web substantial depletion with said core parts ultimately coming to rest generally at said front lower corner of said case; and in which said case front wall is a forwardly opening front wall which may be selectively opened for exposing said core parts which have come to rest generally at said front lower corner of said case for convenient removal.

47. In a dispensing device as defined in claim 42 in which said means mounting said sensor includes means mounting said sensor forwardly and downwardly pivotal forcing said core parts forwardly and downwardly upon said material web substantial depletion; in which said dispensing device includes certain components at said front lower corner of said case; and in which said case front wall is a forwardly opening case front wall with said dispensing device certain components supporting said core parts which have ultimately come to rest generally at said case front lower corner spaced above a lower extremity of said case front wall so that selective opening of said case front wall after said core parts have come to rest causes said core parts to fall out of said case by gravity.

* * * * *